United States Patent [19]

Schudel

[11] 4,178,625

[45] Dec. 11, 1979

[54] LAMP

[76] Inventor: Marcus T. Schudel, 1313 Maple Blvd., Monroe, Mich. 48161

[21] Appl. No.: 909,198

[22] Filed: May 25, 1978

[51] Int. Cl.[2] ..... A47B 97/00

[52] U.S. Cl. ..... 362/131; 362/269; 362/307; 362/396; 362/413; 362/414; 362/427; 362/431

[58] Field of Search ..... 362/413, 418, 414, 131, 362/427, 396, 431, 269, 307

[56] References Cited

U.S. PATENT DOCUMENTS

| | | | |
|---|---|---|---|
| 2,744,997 | 5/1956 | Sefsik et al. | 362/131 |
| 3,729,627 | 4/1973 | Littell | 362/131 |

*Primary Examiner*—Stephen J. Lechert, Jr.

[57] ABSTRACT

A lamp is made from a tubular element having the bottom end disposed at an angle and flattened for receiving a mounted element having a flat finger. The opposite end of the tube has a flexible tube in the nature of a BX wire section extending from the tube and bendable relative thereto. The lamp is shown in one form as being mounted on a tubular frame element of a wheelchair to provide illumination for the occupant. The flat finger is offset outwardly from the securing portion which is of arcuate construction to fit upon the chair tubing and be secured thereon by an adjustable clamping ring. Stability is provided to the tube by angle shaped elements, the horizontal portion being joined to a vertical portion which is of arcuate shape so that it may be clamped, one on the solid tubular element, the other on a tubular element of the upper portion of the chair to fix the lamp to the chair frame at remote points. The clamp with the flattened finger may be mounted on different chairs or on a base to form a floor lamp disposable adjacent to a chair or table.

13 Claims, 8 Drawing Figures

LAMP

BACKGROUND OF THE INVENTION

A search of the art disclosed no such connecting means for the base of a lamp. The best art which was uncovered was found in U.S. Pat. Nos. 931,848; 2,567,686 and 3,341,163 which have little bearing on the present lamp and its supporting structure.

SUMMARY OF THE INVENTION

The invention pertains to a lamp which is made from a substantially vertically disposed solid tubular element which is bent at an angle at the bottom for attachment to a flat finger offset from a supporting portion which may be of different shapes depending on how the finger is supported. A flexible conduit extends within the upper end of the tube and is secured therein with a pair of wires extending through both sections of the tube and out at the bottom angular portion of the substantially vertical tube. The end of the flexible tube is secured to a reflector with the wires projecting thereinto and attached to a socket having a bulb therein for directing light downwardly onto a book, newspaper or the like being read by the chair occupant. A magnifying glass may be removably mounted for adjustment below the lamp so that the occupant of the chair may read therethrough when the eyesight is poor. A bolt is provided through an aperture in the flattened end of the tube and a slot may be provided in the flat finger so that the flattened tube and finger may be fixedly secured after adjustment.

A hollow insulating element is provided at the bottom of the tube through which the wires within the tube sections may be insulated when extending therefrom. The wires extend into the reflector of the lamp and are secured to a socket to form a unit construction. The supporting end for the finger is of arcuate section to fit the tube of the wheelchair to which it is secured by a circular clamping ring. The finger may also extend from a flat section which is bolted to a base so as to have the vertical tube extend upwardly centrally of the base. The tubular element may be braced by a pair of tubes having arcuate ends which are secured to the bottom tube section of the lamp by an adjustable ring or an inverted U-shaped element having one arm attached to a vertical base section and another arm secured to the tube section by a clamping ring for stabilizing the lamp. The finger may also extend from an arcuate section of tube with a securing bracket attached thereto with the ends connected by bolts to permit clamping to occur between a rear cross member of a chair base to support the lamp along the side thereof.

DESCRIPTION OF THE PREFERRED EMBODIMENT

Figure 1:
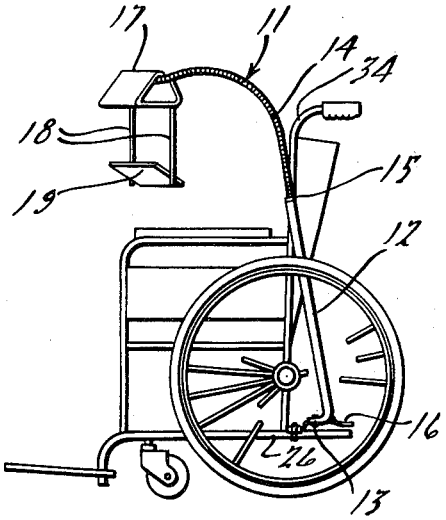
FIG. 1 is a side view of a wheelchair with the lamp of the present invention secured thereto.

The lamp 11 has a tubular bottom portion 12 which is bent at substantially right angle at the bottom end 13. The upper end has a BX section or a flexible tubular element 14 inserted therein which extends outwardly therefrom after being fixed thereto by a threaded sleeve 15. A pair of wires 16 extends through the two sections of tube 12 and 14 with the bottom end being of substantial length and with a plug on the end so that it can be inserted in a socket. The top end is fixed to the end of a reflector 17 with the wires extending therefrom into a socket (not shown) within the reflector. A pair of removable arms 18 may extend downwardly from the reflector for adjustably supporting a magnifying glass 19 which will assist the occupant in reading. The reflector may be adjusted by changing the position of the flexible extending portion 14 of the lamp to fit the comfort of the chair occupant.

Figure 2:
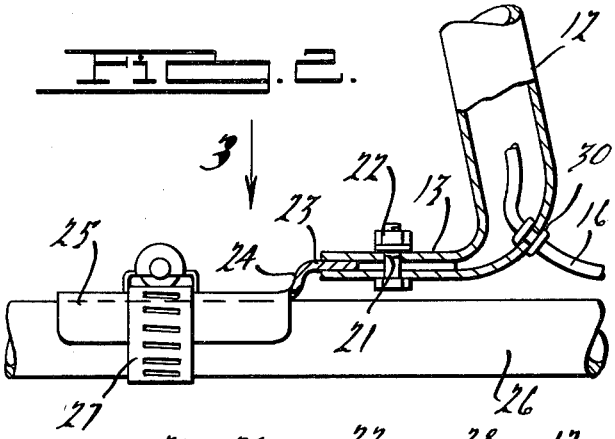
FIG. 2 is an enlarged broken view of the bottom of the lamp tube and its supporting element attached to a tubular member of the wheelchair.
Figure 3:
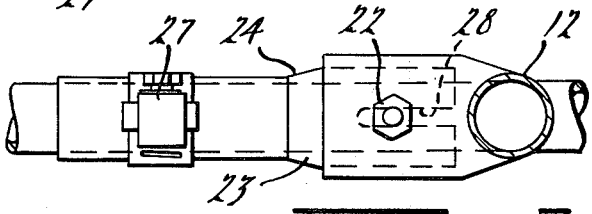
FIG. 3 is a top plan view of the structure illustrated in FIG. 2, as viewed from the point 3 thereof.

In FIG. 2, it will be noted that the flattened end 13 disposed at an angle to the section 12 has been provided with an aperture 21 through which a bolt 22 extends. The flattened end is inserted over a flat finger 23 which is offset by a section 24 extending from one end of a supporting portion 25 which is of arcuate shape to mate with a tubular element 26 on the frame of the chair and to be fixedly secured thereto by an adjustable ring clamp 27. The flat finger 23 has a slot 28 extending inwardly from the end thereof to permit the bolt to slide thereover so that the flattened portion 23 at the bottom of the tube 12 may be fixed to the finger when the bolt 22 is tightened.

Figure 4:
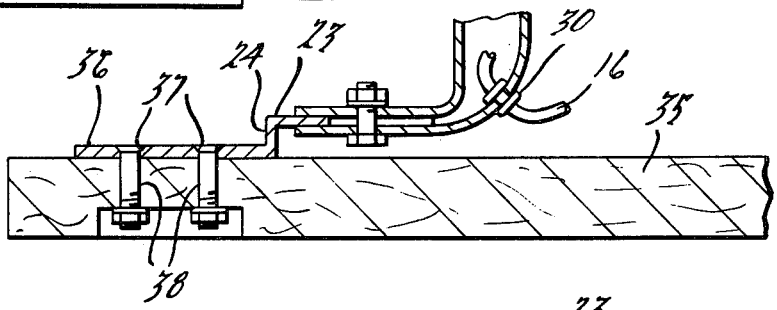
FIG. 4 is a view of the bottom portion of the lamp unit which is secured to a finger which is supported on a base to form a floor type of lamp.

In order to stabilize the lamp unit when secured at the base to the tubular element 26 of the chair frame, a pair of elements 29 have horizontal sections 31 with apertures therethrough for receiving a bolt 32. Downwardly extending attaching portions 33 are of arcuate section to mate with the tubular section 12 and with a tubular section 34 at the upper portion of the chair frame. When the bolt 32 is tightened, the lamp unit tubular section 12 is rigidly fixed to the chair frame. When so fixed, the reflector 17 as well as the magnifying glass 19 may be adjusted at the will of the chair occupant. The lamp unit, as above described for the wheelchair, may also be attached to a base 35, as illustrated in FIG. 4. The bracket has a finger 23 and an offset section 24 extending from a flat securing portion 36. The portion 36 has a pair of apertures 37 therethrough for a pair of bolts 38 which fixedly secures the flat supporting portion 36 to the base 35 to which the lamp unit is attached.

Figure 6:
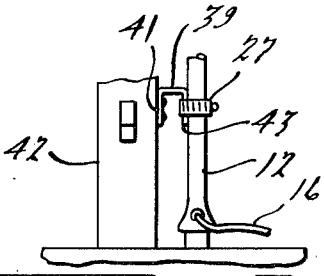
FIG. 6 is a view of the structure illustrated in FIG. 4, showing a clamp for bracing the lamp when secured to an element on the base.
Figure 7:
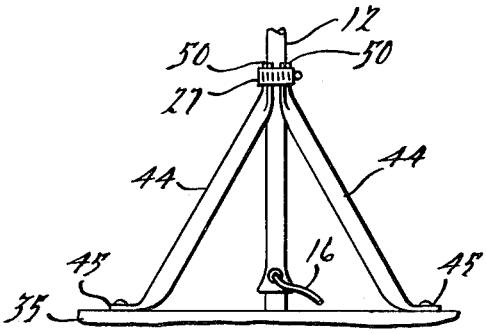
FIG. 7 is a view of structure, similar to that illustrated in FIG. 6, showing a pair of angularly disposed tubular elements for stabilizing the lamp unit.

In FIG. 6, an inverting U-shaped bracket 39 has an arm 41 secured to a vertically extending element 42 on the base which is herein illustrated as a part of a pump. A second arm 43 of the bracket 39 is of arcuate section and secured by a clamping ring 24 to the tubular section 12 of the lamp unit. With this arrangement, the lamp unit is solidly fixed to the base structure and can readily function as a floor lamp. A stabilizing structure for the floor type of lamp unit is illustrated in FIG. 7 wherein a pair of angularly disposed tubular elements 44 have flattened bottom ends 45 secured to the base 35. The top ends 50 are of arcuate shape and are secured to the tubular portion 12 by a ring clamp 27.

Figure 5:
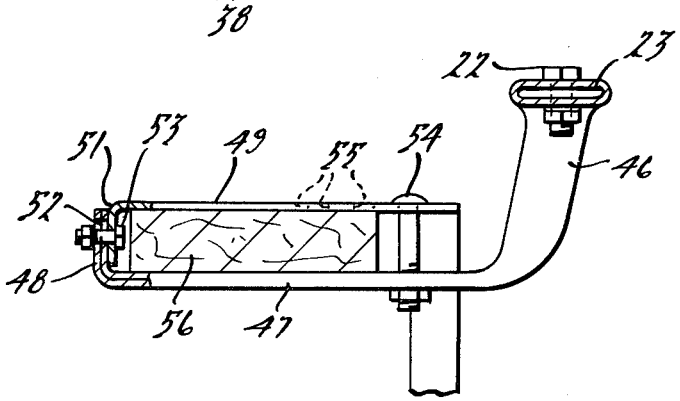
FIG. 5 is a view of a bracket having a supporting portion which is secured to a clamp which may be attached to a cross member on the base at the rear of a chair.
Figure 8:
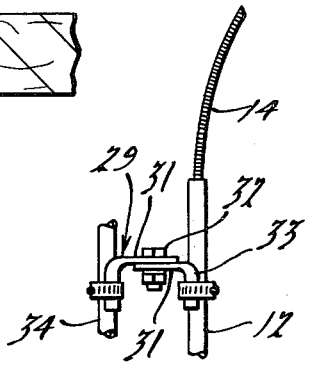
FIG. 8 is a view of the chair illustrated in FIG. 1 having the upper portion of the bottom tube braced by a pair of connected elements having acruate portions secured to an element of the chair and the upper portion of the lamp unit tube.

Referring to the structure of FIG. 5, a flat end 23 for receiving the flattened angular end 13 of the lamp unit with apertures 21 and 28 for receiving the bolt 22 is disposed on the end of an arcuately shaped tubular portion 46. The opposite end of the tubular portion has a straight flattened section 47 which is bent upwardly at the end 48. A bracket element 49 is bent downwardly at 51 and provided with a slot 52 which mates with a similar slot in the end 48. A clamping bolt 53 extends through the slots 52 while a bolt 54 extends through one of a plurality of apertures 55 in the clamping portion 49 and in the section 47. The bolt 54 secures the section 47 and bracket element 49 on a cross member 56 at the rear portion of a chair so as to have the lamp extend upwardly thereat in adjustable relation to the chair occupant.

What is claimed is:

1. A lamp unit embodying a solid tube section, a flexible tube section extending from within said solid tube section outwardly thereof, the bottom of the solid tube section being bent at an angle and flattened, a flat finger extendable into the tube flattened end, a support for said flattened finger, said support being engageable with a supporting element, and means for securing said support in fixed relation to said supporting element with the flat finger parallel to and spaced from said support.

2. A lamp unit as recited in claim 1, wherein a pair of apertures through said finger and said flattened portion of the solid tube section are in aligned relation, and a bolt extending through said apertures for securing the lamp unit in fixed relation to said support.

3. A lamp unit as recited in claim 1, wherein the aperture in said finger is a slot to permit the bolt when extending through the apertures of the flattened portion of the solid tube section to be moved therewithin.

4. A lamp unit as recited in claim 1, wherein said supporting portion of the flat finger is of arcuate shape to fit a tubular portion of a wheelchair frame, and said means is an adjustable securing ring.

5. A lamp unit as recited in claim 4, wherein a bracing means connects the solid tube section to the upper portion of the chair frame to secure the lamp unit in fixed position.

6. A lamp unit as recited in claim 4, wherein a reflector is supported on the end of the flexible tube, wires through said tubes, a socket on the end of said flexible tube within the reflector to which the top ends of the wires are connected, and a plug on the bottom end of the wires which extend from an aperture through the wall of said solid tube section.

7. A lamp unit as recited in claim 1, wherein said supporting element is a base for forming a floor lamp to which the flat finger is secured, said solid tube section being located substantially central of said base.

8. A lamp unit as recited in claim 7, wherein bracing means retains said solid tube section substantially in vertical position.

9. A lamp unit as recited in claim 8, wherein said bracing means are tubular elements secured to said base and to said solid tubular element.

10. A lamp unit as recited in claim 8, wherein said bracing means includes a rigid vertical element on said base, and means connecting said solid tube section to said element.

11. A lamp unit as recited in claim 6, wherein a magnifying glass is adjustably supported on said reflector.

12. A lamp unit as recited in claim 11, wherein said magnifying glass is removably supported on said reflector.

13. A lamp unit as recited in claim 1, wherein said supporting element is a cross member at the bottom of a chair, said support being an extension at right angles to said finger, a bracket element secured in spaced relation to said right-angle extension, and bolts clamping said extension and bracket together and about said cross member.

* * * * *